US005174571A

United States Patent [19]

Aubusson et al.

[11] Patent Number: 5,174,571

[45] Date of Patent: Dec. 29, 1992

[54] TEMPORARY LINE MARKING METHOD AND APPARATUS

[76] Inventors: Russell C. Aubusson, 40, Townshend Avenue, Irby, Wirral, Merseyside L61 2XW; Christina Thomas, 41, Warren Drive, Wallasey Merseyside, L45 OJW; William Henry, 26, Longdean Park, Chester-le-Street, County Durham DH3 4DF, all of England

[21] Appl. No.: 623,796

[22] PCT Filed: Jun. 23, 1989

[86] PCT No.: PCT/GB89/00713

§ 371 Date: Dec. 20, 1990

§ 102(e) Date: Dec. 20, 1990

[87] PCT Pub. No.: WO89/12484

PCT Pub. Date: Dec. 28, 1989

[30] Foreign Application Priority Data

Jun. 23, 1988 [GB] United Kingdom ..... 8815011

[51] Int. Cl.[5] ..... A63C 19/00

[52] U.S. Cl. ..... 273/31; 250/458.1; 273/DIG. 24; 356/375

[58] Field of Search ..... 273/DIG. 24, 62, 30, 273/186 C; 250/462.1, 461.1, 458.1

[56] References Cited

U.S. PATENT DOCUMENTS

| | | | |
|---|---|---|---|
| 3,573,457 | 4/1971 | Grant | 273/DIG. 2 X |
| 3,649,029 | 3/1972 | Worrell | 273/DIG. 2 X |
| 3,917,264 | 11/1975 | Davidson et al. | 273/DIG. 2 X |
| 3,971,560 | 7/1976 | Pamosh | 273/DIG. 2 X |
| 4,347,328 | 9/1980 | Tekippe | 273/DIG. 2 X |
| 4,565,022 | 9/1982 | Chapkin | 273/DIG. 2 X |
| 4,642,526 | 9/1984 | Hopkins | 273/DIG. 2 X |
| 4,710,635 | 12/1987 | Chupp | 273/DIG. 2 X |
| 4,744,663 | 5/1988 | Hamashima | 273/DIG. 2 X |
| 4,745,276 | 5/1988 | Broicher et al. | 273/DIG. 2 X |

*Primary Examiner*—Theatrice Brown

*Attorney, Agent, or Firm*—Zarley, McKee, Thomte, Voorhees & Sease

[57] ABSTRACT

An apparatus for forming visible lines on a surface on a temporary basis comprises at least one laser which is directed at phosphors provided in or on the surface and means for controlling the laser to cause it to sweep the area on which the lines are to be marked. Optical deflectors are provided for guiding the laser beam. A first method of forming such lines comprises sweeping the surface incorporating the phosphors and on which the lines are to be marked with at least one laser beam. In a second method, the area is again swept by the at least one laser beam and, after the phosphors have been activated, each laser beam is deactivated and the phosphors are stimulated by flood radiation. Such phopsphorescence can then be quenched at a desired time.

27 Claims, 1 Drawing Sheet

TEMPORARY LINE MARKING METHOD AND APPARATUS

FIELD OF THE INVENTION

The present invention relates to a method and apparatus for forming visible lines of demarcation on a temporary basis. More particularly, the invention relates to a method and apparatus to be used primarily, but not exclusively, for forming the demarcation lines of the playing surface of a number of different sports in a multi-purpose area but in which only the demarcation lines for any one particular sport are visible at any one time.

BACKGROUND OF THE INVENTION AND PRIOR ART DISCUSSION

Many indoor sports require a playing area which is relatively large, and certain of these, such as tennis, require additional space, for example, a run-back area, which may be larger than the playing area itself. The provision of such a relatively large area which is maintained solely for the playing of a single sport is therefore extremely wasteful of space and is economically undesirable.

Accordingly, there has been a tendency, in most recent times, to provide multi-functional indoor sports arenas. However, this solution has its own inherent disadvantages. Firstly, the line markings for each sport are, to all intents and purposes, permanently visible. Thus, it is customary for the demarcation lines for each sport to be in the form of strips of plastics material which are applied to the floor of the area by means of an adhesive. The strips are provided in different colours so that, for example, white strips demarcate a badminton court, whilst red strips denote a basketball court. However, there are numerous instances where a large number of different coloured lines are present in a small area and this is highly likely to cause confusion in the mind of a player.

An alternative method of providing line markings for a number of different sports in a single playing area is to employ a translucent playing surface with the demarcation lines of the playing area being located beneath such surface and being illuminated by strip lighting from below the line. This solution is, however, extremely expensive and, in many situations, is not economically viable.

The use of laser beams to produce visible line markings is known. Thus, for example, in U. S. Pat. No. 3,741,662, there is disclosed a method of providing a constant wall of visible light for visually demarcating a scoring or score-advancing line wherein movement through such wall is of significance in playing the game. In such method a laser beam is directed horizontally from outside the playing area and is reciprocated vertically to create and maintain the vertical wall of light.

In U. S. Pat. No. 4,090,708, a number of somewhat similar arrangements are disclosed. In a first embodiment, this prior specification provides a single laser beam having a luminous horizontal segment directed across the playing area which acts as an overhead line of demarcation in combination with a relatively lower parallel luminous segment of the same beam which is reflected reversely across the playing area to provided a ground-level demarcation line. Alternatively, two oppositely travelling light beams having a pair of horizontal luminous segments serve as a composite overhead demarcation line. These are employed in combination with a second pair of horizontal, relatively lower, luminous segments of the same beams which serve as a ground-level demarcation line.

Neither of these prior specifications is of particular relevance to the present invention in that they are chiefly concerned with identifying particular situations occurring during the playing of the game, such as the attainment of first-down yardage in American Football or whether a ball lands in or out of court during a game of tennis. Neither prior specification discloses, or even considers, the possibility of utilising laser technology to define the actual playing area. It therefore follows that neither specification even remotely considers the use of laser technology to provide demarcation lines on an otherwise unmarked area, which demarcation lines can be varied almost at will and extremely rapidly.

OBJECTS OF THE INVENTION

The present invention primarily seeks to provide a method and apparatus for forming visible lines of demarcation, on a temporary basis on an otherwise unmarked floor area utilising laser beams. The invention also seeks to provide a method and apparatus whereby a first set of demarcation lines can be removed substantially instantaneously and replaced by a second set of demarcation lines.

The present invention also seeks to provide a method and apparatus which can be used for forming such lines in complete safety to the players of a game without the necessity for such players to wear protective clothing or glasses.

Still further, the present invention seeks to provide a method and apparatus which are computer-controlled and to which additional programs may be added to permit additional sets of demarcation lines to be provided as and when required, which has not hitherto been possible.

SUMMARY OF THE INVENTION

According to the present invention, there is provided an apparatus for forming visible lines of demarcation on a temporary basis on a surface, the surface including phosphor means excitable by radiation to produce phosphorescence in the visible region of the electromagnetic spectrum, comprising at least one laser capable of producing a coherent beam of radiation within the ultraviolet region of the electromagnetic spectrum, optical deflector means for directing said beam onto the surface area, said deflector means being capable of scanning the entire surface to be provided with said demarcation lines, and control means including electronic processing means programmed to cause said laser to scan said entire surface at a predetermined rate and for actuating the laser in those regions where said lines are to be provided.

Also according to the present invention, there is provided a method of forming visible lines of demarcation on a temporary basis on a suitable surface comprising the steps of:

(a) providing the surface on which the lines are to be marked with phosphor means excitable by radiation to produce phosphorescence in the visible region of the electromagnetic spectrum.

(b) providing at least one laser capable of producing a coherent beam of radiation in the ultraviolet region of the electromagnetic spectrum and which is directable at said surface.

(c) providing optical deflector means for each said laser; and (d) providing electronic control means for controlling each said laser and deflector means;

whereby said control means causes each said laser to scan said entire surface to be marked at a predetermined rate which is sufficiently high to prevent flicker and actuates said laser in those regions of said surface where said lines are to be marked.

In a preferred aspect such method comprises the additional step of providing a beam splitter for splitting at least one of the laser beams into two or more component beams and passing each said component beam through said optical deflector means.

Still further according to the present invention, there is provided a method of forming visible lines of demarcation on a temporary basis on a suitable surface comprising the steps of:

(a) providing the surface on which the lines are to be marked with phosphor means excitable by radiation to produce phosphorescence in the visible region of the electromagnetic spectrum, (b) providing at least one laser capable of producing a coherent beam of radiation in the ultraviolet region of the electromagnetic spectrum and which is directable at said surface (c) providing optical deflector means for each said laser;

(d) providing electronic control means for controlling each said laser and deflector means; and (e) providing a source of infra-red radiation directable at said surface and actuatable by said control means;

whereby said control means is actuated to cause each said laser to scan said entire surface to be marked at a sweep rate which is sufficiently high to prevent flicker and actuates each said laser when directed at those regions of said surface where said lines are to be marked, said laser actuation causing activation of said phosphor means, the control unit then causing deactuation of the laser and actuating the infra-red radiation source, said surface being provided with flood illumination by said infra-red radiation source. In this latter instance, it is preferred if the method comprises the additional step of providing a high-energy radiation source directable at said surface and having an energy selected to quench the phosphorescence of said phosphor means when the lines are no longer required.

The scanning may be effected either by vector scanning or raster scanning.

In considering the method and apparatus of the present invention, it will be readily apparent that certain features are of paramount importance.

Firstly, a laser per se cannot produce demarcation lines for a sport in a satisfactory manner. Accordingly, the laser beam needs to be directed onto a suitable phosphorescent material which, when excited by the laser beam, has the overall effect of emitting light at a wavelength which is in the visible region of the electromagnetic spectrum and, ideally, is close to that at which the human eye has maximum sensitivity. To provide useful demarcation lines, it is desirable that the phosphorescent material has a long presistence.

It follows that, once the phosphorescent material has been selected, it is necessary to select an appropriate laser which is capable of providing the necessary excitation energy.

Furthermore, a mechanical drive system is necessary to move the laser optics to scan the area which is to be marked. Finally, it is necessary to provide the necessary computer control arrangements to control the selection and drive of the laser optics. The scanning rate and the persistence of the phosphorescent material are linked parameters but are not necessarily independent. For example, if the persistence is greater than, say, one second, the sweep rate could be made substantially lower than would otherwise be the case but need not be. On the other hand, if the phosphor has a shorter persistence; then problems of flicker can be avoided by ensuring that the sweep rate is in excess of 25 sweeps per second.

In so far as the or each laser is concerned, it has been found that one which emits radiation in the range of 370 to 400 nm is preferred. In this connection, a 7w ion laser is deemed advantageous. A preferred phosphor material which satisfies the above criteria is a ZnS phosphor. This phosphor may be doped with materials such as copper or manganese to provide variation of the wavelength of the emitted light within the visible region of the electromagnetic spectrum .

To permit directional scanning to be achieved, an optical deflector must be utilised and this is preferably a galvanometer-type or diffraction-grating type deflector.

The control unit is an electronic processing means programmed to cause the scanning. Advantageously, such means are in the form of a microprocessor.

The phosphorescent material may be embedded in the surface on which the lines are to be marked or may be applied to the base surface in the form of a coating such as a paint.

BRIEF DESCRIPTION OF THE DRAWINGS

The invention will be further described, by way of example, with reference to the accompanying drawings, in which.

DESCRIPTION OF PREFERRED EMBODIMENTS

Figure 1:
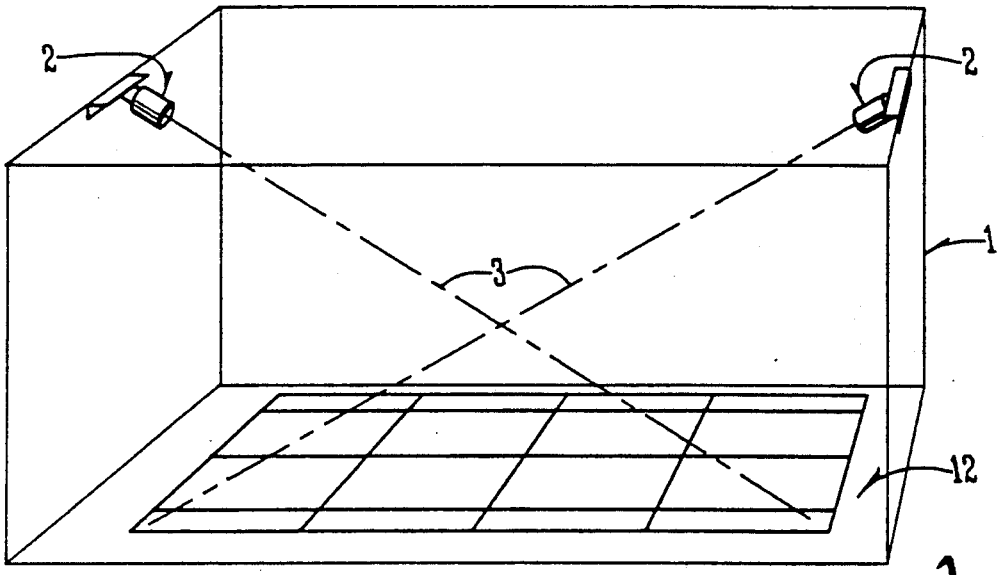
FIG. 1 is a schematic illustration of an apparatus for forming visible demarcation lines in accordance with the present invention.

Before describing an embodiment of the present invention with respect to the drawings, certain general comments may prove helpful.

A very large number of phosphor compounds exist. When excited by a suitable energy source, these compounds produce the characteristic of fluorescence or phosphorescence. Fluorescence is normally understood to mean that the afterglow is detectable for less than $10^{-8}$ seconds whilst phosphorescence denotes that the afterglow is detectable for longer than $10^{-8}$ seconds. Phosphors can, in general, be stimulated if the phosphorescence intensity increases as a result of irradiation and can be quenched if such intensity decreases during irradiation. Thus, for example, cubic-Sr (S:Se) phosphor, which is $SrSO_4$: $CaF_2$: Sm:Eu, can be excited by ultraviolet radiation, stimulated by infra-red radiation and quenched by orange light.

To produce phosphorescence, a phosphor must usually include impurities in a host crystal. During excitation, an electron is promoted from the highest available, full, energy band in the host crystal to the next highest, normally empty, energy band. The excited electron tends to lose energy rapidly to the crystal (in the form of phonons or heat). It will therefore tend to drop back to the energy level from which it is promoted. However, as it does so, it may become trapped in an intermediate energy level introduced by the impurity. Such trapped electrons can be re-promoted by the application of an external energy source and this constitutes the stimulation.

Luminescent emission occurs when an electron enables a radiation translation from near the conduction band to combine with a positive hole in the activator band.

In general, the phosphor compounds are activated by lasers. Certain criteria must be observed in selecting which laser to be used. Most importantly, there are strict safety requirements to be met. It will be readily apparent that there is a maximum permissible safe exposure time and a nominal ocular hazard distance associated with any laser. In Great Britain, these features are set forth in British Standard No. BS 4803 Part 3.

In addition to satisfying the safety criteria, it is necessary to ensure that the laser can produce the required radiance levels to excite the particular phosphor being used. This can be theoretically calculated. The beam spread angle (0) is equal to 1.27 times the laser wavelength divided by the beam waist diameter. The radiance (Le) on an area A located at a distance R from the laser is given by the formula:

$$Le = \frac{\phi e}{\Delta\Omega\Delta A}$$

$$\text{wherein } \Delta\Omega = \frac{B}{R^2} \text{ and } B = \pi\left(R \tan\frac{\phi}{2}\right)^2 = \frac{\pi R^2 \phi^2}{4}$$

Accordingly, $$Le = \frac{4\phi e}{\pi\phi^2\Delta A}$$

Thus, taking a 4 mw Ne-He laser having a wavelength of 632.8 nm, the radiance acting on an area of 2 square centimeters can be calculated as $10^7$ watts/$m^2$ or 1 KW/$cm^2$.

The laser must scan the area upon which the demarcation lines are to be provided. It will be readily appreciated that such scanning should be effected at a rate which is in excess of 25 passes per second to eliminate flicker. To reduce the flicker effect further, the phosphor is so selected that the persistence of the phosphorescence is considerably longer than the interval between successive passes.

Referring now to the drawings, FIG. 1 shows, schematically, one embodiment of an apparatus for forming visible demarcation lines on a temporary basis in accordance with the present invention. In this embodiment, the lines for a badminton court are to be marked on the floor 12 of a sports hall 1. As shown, two laser systems 2 are provided, these being mounted high above the floor 12. Each system 2 is designated to scan a beam of radiation having a wavelength of between 370 and 400 nm and an appropriate intensity across the floor area 12 to be marked. The playing surface 12 may incorporate suitable phosphors, be coated with a surface finish containing suitable phosphors, or may be made from a phosphor material.

Figure 2:
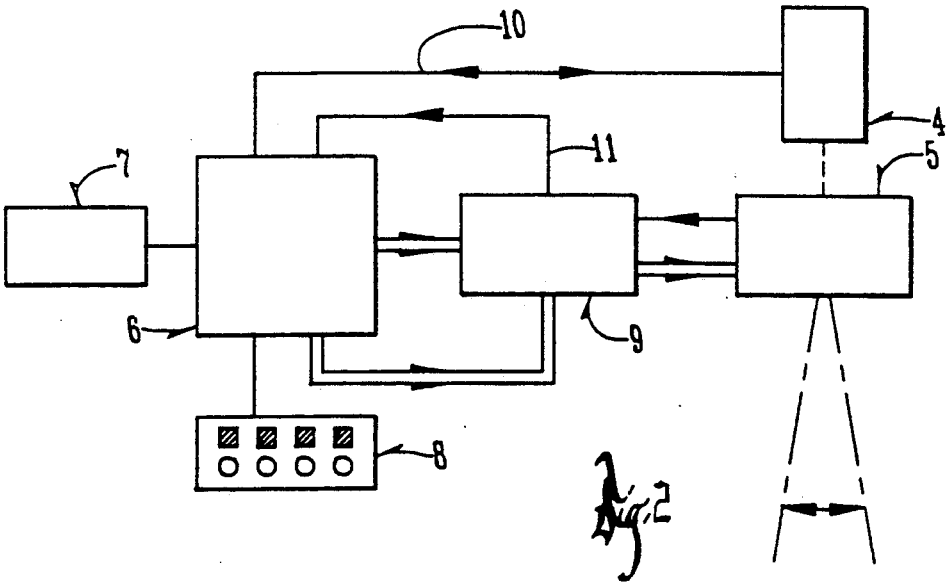
FIG. 2 is a block diagram of the apparatus shown in FIG. 1.

In FIG. 2, a block diagram of the apparatus is shown. Each laser unit 4 produces a coherent beam of radiation in the mid-ultraviolet portion of the electromagnetic spectrum in the region of 370 to 400 nm. The phosphor material is a ZnS phosphor which phosphoresces, with a sufficiently long decay time after ultraviolet radiation, in the visible portion of the spectrum. By doping the phosphor with materials such as copper or manganese, the emission from the phosphor can be altered in colour. To impart sufficient energy to the phosphor, a 7 w ion laser will typically be required.

From the laser 4, the beam enters a deflector unit 5. The deflector unit 5 is provided with signals for controlling its movements from an electronic deflection interface 9 connected to a computer system 6. Under the programmed control of the computer, the deflector unit 5 provides a vectored scan of the lines to be marked on the surface 12. The entire court area is scanned at a rate in excess of twenty-five times per second. The deflector unit 5 may either be of the galvanometer or diffraction grating type, providing movement along both the X and Y-axes. If desired or appropriate, the diffraction grating can be produced by acousto-optical means.

The computer 6 is programmed with the details of the lines to be marked and the program is entered utilising a keyboard 7 and run by the actuation of appropriate contacts on an operating panel 8.

It is a possible source of danger that the scanning mechanism may break down whilst a laser 4 is activated. To prevent this, the deflector unit 5 is continuously monitored by the computer 6 and the interface 9. If such a breakdown occurs, an alarm signal 11 actuates the microprocessor 6 to switch off the appropriate laser 4.

A variety of different programs are provided so that court markings for a variety of different sports may be provided simply by actuating an appropriate push-button on the control panel 8. New programs can be loaded as desired by means of the keyboard 7. Whilst reference has, in the main, been made to the marking of sports courts, it is evident that the apparatus of the present invention has other uses such as prompt markings for the layout of apparatus or seating and markings for the teaching of dance or gymnastics.

As previously mentioned, the playing surface contains, or is coated with, suitable phosphors. If desired, the coating may be in the form of a paint. If a paint is used, then little or no modification of the flooring of a conventional sports hall would be necessary. On the other hand, the inclusion of the phosphors in a specially prepared surface, such as a synthetic carpet, would be more durable. To reduce the need for accuracy of the alignment of the laser beams 3, it would be possible to paint the lines on the floor of the hall with a paint containing an appropriate phosphor material, the colour of the paint being, as far as possible, the same as that of the remainder of the floor. The laser beams 3 could be then be programmed to scan a broader band than would otherwise be the case so that the line areas would remain illuminated even if some accidental misalignment of the beam occurred.

For increased contrast, the playing surface itself may be a relatively dark colour containing a phosphorescent material which absorbs the laser radiation but emits light in the visible region of the electromagnetic spectrum. The use of such a material avoids spurious light emission from the players or the ball or shuttle cock as they pass over the scanned area because the laser need not operate at a visible wavelength.

It will be observed that two lasers 4 are used, each of which scans the full area of the demarcation lines. This is to avoid shadowing of the lines by the players or by the court fixtures and fittings. The use of two lasers provides the advantage that the amount of incident energy required from each laser for adequate illumination is reduced. This, in turn, means that a less expensive laser can be used and also reduces further the possibility of injury caused by exposure of the eyes to the laser beam. However, although two lasers constitute the preferred embodiment, the invention is not limited to such a number.

In a modified embodiment of the present invention, each laser still emits a beam which is at a wavelength in the ultraviolet portion of the electromagnetic spectrum. However, in this embodiment, the excitation of the phosphors is effected by a higher powered laser. To overcome safety problems, court users would be excluded whilst such excitation is taking place. Thereafter, the laser is switched off and the phosphors are stimulated by lower energy flood radiation in the infra-red portion of the electro-magnetic spectrum. The phosphorescence can then be quenched, at a desired time, by radiation, utilising an appropriate energy source, at higher energy levels then the flood radiation. Such an embodiment substantially reduces any possible health hazards because members of the public will only be present whilst the stimulation, and not the excitation, of the phosphors is taking place. Furthermore, with omnidirectional flood illumination, no shadowing of the lines occurs.

The scanning of the surface may be effected by vector scanning or raster scanning, whichever is deemed more appropriate.

Finally, although the present invention has been described primarily with reference to the marking of lines in indoor arenas, the apparatus and method could also be used in outdoor environments.

We claim:

1. An apparatus for forming visible lines of demarcation on a temporary basis on a surface, said surface including phosphor means wherein said phosphor means are disposed uniformly over all of said surface, said phosphor means being excitable by radiation to produce phosphorescence in the visible region of the electromagnetic spectrum, said apparatus comprising:

at least one laser means capable of producing a beam of radiation within the ultraviolet region of the electromagnetic spectrum;

displaceable optical deflector means for directing said laser beam onto said surface, said deflector means being capable of directing said beam onto any portion of said surface;

control means controlling both the displacement of said optical deflector and the actuation of said laser means, said control means including electronic processing means programmed to cause said laser means to produce said beam and to cause said beam deflected by said optical deflector means to scan said surface in a pre-determined pattern and at a predetermined rate, whereby said beam excites only said phosphor means in said pattern to cause said phosphor means to phosphoresce, said phosphorescence producing desired lines of demarcation on said surface in said desired pattern in said visible region of said electromagnetic spectrum.

2. An apparatus according to claim 1 wherein two laser means are provided.

3. An apparatus according to claim 2 wherein the laser means are mounted above the surface to be marked and at opposed ends thereof.

4. An apparatus according to claim 1 wherein a single laser means is provided, said apparatus further comprising means for splitting the beam produced by said laser means into at least two component beams.

5. An apparatus according to claim 1 in which said laser means emits a beam having a wavelength of between 370 and 400 nm.

6. An apparatus according to claim 1 wherein the laser means is a 7 w ion laser.

7. An apparatus according to claim 1 wherein the deflector means is a galvanometer-type deflector.

8. An apparatus according to claim 1 wherein the deflector means is a diffraction grating-type deflector.

9. An apparatus according to claim 8 wherein the diffraction grating is produced by acousto-optical means.

10. An apparatus according to claim 1 wherein the electronic processing means is a microprocessor.

11. An apparatus according to claim 1 wherein the phosphor means are impregnated into the surface to be provided with lines of demarcation.

12. An apparatus according to claim 1 wherein the phosphor means are incorporated into a paint applied to the surface.

13. An apparatus as claimed according to claim 1 wherein the phosphor is a ZnS phosphor.

14. An apparatus according to claim 13 wherein the ZnS phosphor is doped with at least one impurity to modify the wavelength of the emitted light after excitation of the phosphor by the laser means.

15. An apparatus according to claim 1 wherein said predetermined rate is in excess of 25 sweeps per second.

16. A method of forming visible lines of demarcation on a temporary basis on a surface comprising the steps of:

(a) providing phosphor means excitable by radiation to produce phosphorescence in the visible region of the electromagnetic spectrum uniformly over said surface;

(b) providing at least one laser means capable of producing a beam of radiation in the ultraviolet region of said electromagnetic spectrum for exciting said phosphor means.

(c) providing displaceable optical deflector means for deflecting said beam from said laser means onto said surface;

(d) providing electronic control means for controlling said laser means and said displacement of said optical deflector means;

(e) actuating said laser means to produce said beam;

(f) controlling said displacement of said optical deflector means to cause said beam produced by said laser means to scan said surface in a predetermined pattern and at a predetermined rate which is sufficiently high to prevent flicker whereby said beam excites said phosphor means disposed on said surface in said predetermined pattern, said phosphorescence from said excited phosphor means forming said lines of demarcation; and (g) continuing said scanning for as long as said lines of demarcation are required.

17. A method according to claim 16 comprising the additional step of providing a beam splitter for splitting at least one of the laser beams into two or more component beams and passing each said component beam through said optical deflector means.

18. A method according to claim 16 wherein the scanning is effected by vector scanning.

19. A method according to claim 16 wherein the scanning is effected by raster scanning.

20. A method according to claim 16 wherein the scanning is effected at a rate which is in excess of 15 sweeps per second of the surface to be marked.

21. A method according to claim 16 wherein the laser means emits radiation at a wavelength which lies within the range of 370 to 400 nm.

22. A method of forming visible lines of demarcation on a temporary basis on a surface comprising the steps of:

(a) providing phosphor means excitable by radiation to produce phosphorescence in the visible region of the electromagnetic spectrum uniformly over said surface;

(b) providing at least one laser means capable of producing a beam of radiation in the ultraviolet region of said electromagnetic spectrum for exciting said phosphor means;

(c) providing displaceable optical deflector means for deflecting said beam from said laser means onto said surface;

(d) providing a source of infra-red radiation directable at said surface and capable of flood illuminating said surface;

(e) providing electronic control means for controlling said laser means, said displacement of said optical deflector means and said source of infra-red radiation;

(f) actuating said laser means to produce said beam;

(g) controlling said displacement of said optical deflector means to cause said beam produced by said laser means to scan said surface in a predetermined pattern and at a predetermined rate which is sufficiently high to prevent flicker, whereby said beam excites said phosphor means disposed on said surface in said predetermined pattern, said phosphorescence from said excited phosphor means forming said lines of demarcation; and (h) deactuating said laser means and actuating said source of infra-red radiation to provide floor illumination of said surface.

23. A method according to claim 22 comprising the additional step of providing a high-energy radiation source directable at said surface and having an energy selected to quench the phosphorescence of said phosphor means when the lines are no longer required.

24. A method according to claim 22 wherein the scanning is effected by vector scanning.

25. A method according to claim 22 wherein the scanning is effected by raster scanning.

26. A method according to claim 22 said scanning is effected at a rate which is in excess of 25 sweeps per second of the surface to be marked.

27. A method according to claim 22 wherein the laser means emits radiation at a wavelength which lies within the range of 370 to 400 nm.

* * * * *